US005530459A

United States Patent [19]

Kline et al.

[11] Patent Number: 5,530,459

[45] Date of Patent: *Jun. 25, 1996

[54] PRINTING MEDIA FEED AND RETAINING APPARATUS FOR A THERMAL INKJET PRINTER/PLOTTER

[75] Inventors: Daniel S. Kline, Carlsbad; Frank Nasworthy, Leucadia; Paul J. Wield, San Diego, all of Calif.

[73] Assignee: Hewlett-Packard Company, Palo Alto, Calif.

[ * ] Notice: The term of this patent shall not extend beyond the expiration date of Pat. No. 5,363,129.

[21] Appl. No.: 298,895

[22] Filed: Aug. 31, 1994

Related U.S. Application Data

[62] Division of Ser. No. 785,832, Oct. 31, 1991, Pat. No. 5,363,129.

[51] Int. Cl.[6] ..... B41J 13/00

[52] U.S. Cl. ..... 346/136; 347/104; 400/637.2

[58] Field of Search ..... 346/134, 136; 347/104; 400/638, 639.1, 636.3, 637, 637.1, 637.2, 637.5, 636; 271/272, 275, 277

[56] References Cited

U.S. PATENT DOCUMENTS 4,408,917 10/1983 Iwai et al. ..... 400/637.2
5,363,129 11/1994 Kline et al. ..... 346/136

*Primary Examiner*—Huan H. Tran
*Assistant Examiner*—Alrick Bobb

[57] ABSTRACT

In a computer driven printer/plotter, a printing media feed and retaining apparatus which has at least three pinch rollers mounted on a pinch roller support member having a print media guide surface and a support and actuation arm extending from a side of the pinch roller support member opposite the guide surface, and wherein an axis of said support and actuation arm intersects a vertical centerline through the middle of a polygon figure defined by intersection of straight lines between pinch rollers and having one pinch roller at each corner thereof. The pinch rollers are supported such that they are self centering and track without skewing or damaging the printing medium without the use of precision parts or mounting techniques.

8 Claims, 3 Drawing Sheets

PRINTING MEDIA FEED AND RETAINING APPARATUS FOR A THERMAL INKJET PRINTER/PLOTTER

This is a divisional of application Ser. No. 07/785,832 filed on Oct. 31, 1991 U.S. Pat. No. 5,363,129.

BACKGROUND OF THE INVENTION

The present invention pertains to the field of computer driven printer/plotters particularly designed for producing engineering or other large drawings on paper, vellum, film or other printing media which is drawn through the mechanism from a roll thereof. Typically, the medium may have a width from 8½ inches to as much as 3 or 4 feet or more.

With reference to a rectangular coordinate system, the paper or other printing medium is drawn through the printer in the X direction and a thermal inkjet printer carriage is mounted for movement transversely of the paper in what shall be referred to as the Y direction. A sheet of paper or other printing medium is either manually fed or paper is drawn from a supply roll thereof around a platen roller which may or may not be power driven. Since the printer/plotter apparatus with which the present invention is used employs a thermal inkjet printing head or heads, precise control of the spacing between the print heads and the surface of the medium on which printing is to take place is essential otherwise acceptable print resolution is lost.

When paper or other printing medium is first fed into the printer/plotter, provision must be made to accurately guide it around the drive or platen roller in a direction which is perpendicular to the axis of the platen roller without wrinkling or crimping of the medium upon which printing is to take place. Prior art pinch rollers which pinch the printing medium against the drive or platen roller frequently do not accurately track in the direction of movement of the medium (the X direction) thus causing misalignment and/or wrinkling or tearing of the printing medium. The present invention is directed to the problem of providing a print medium feed and holding arrangement using pinch rollers which may be easily retracted away from the platen roller for feeding of the printing medium into the printer/plotter and which, when in pinching position wherein the pinch rollers are spring biased against the printing medium thus pinching it against the platen roller, are self centering whereby the tracking of the pinch rollers is precisely in the X direction thus preventing misalignment or damage to the printing medium.

Accordingly, the present invention provides a printing media feed and retaining apparatus for a printer/plotter comprising:

a) a pinch roller support member having an arcuate media guide surface thereon, said support member being moveable into and out of a pinching position adjacent a platen roller;

b) said pinch roller support member having a plurality of pinch rollers freely rotatably mounted on at least two spaced parallel axles affixed to said print roller support member; and c) said pinch roller support member having a support and actuation arm extending therefrom on the side opposite said arcuate media guide surface, said arm being positioned substantially in the middle of a polygon having one each of said pinch rollers at the intersections of the sides thereof.

DETAILED DESCRIPTION

Figure 1:
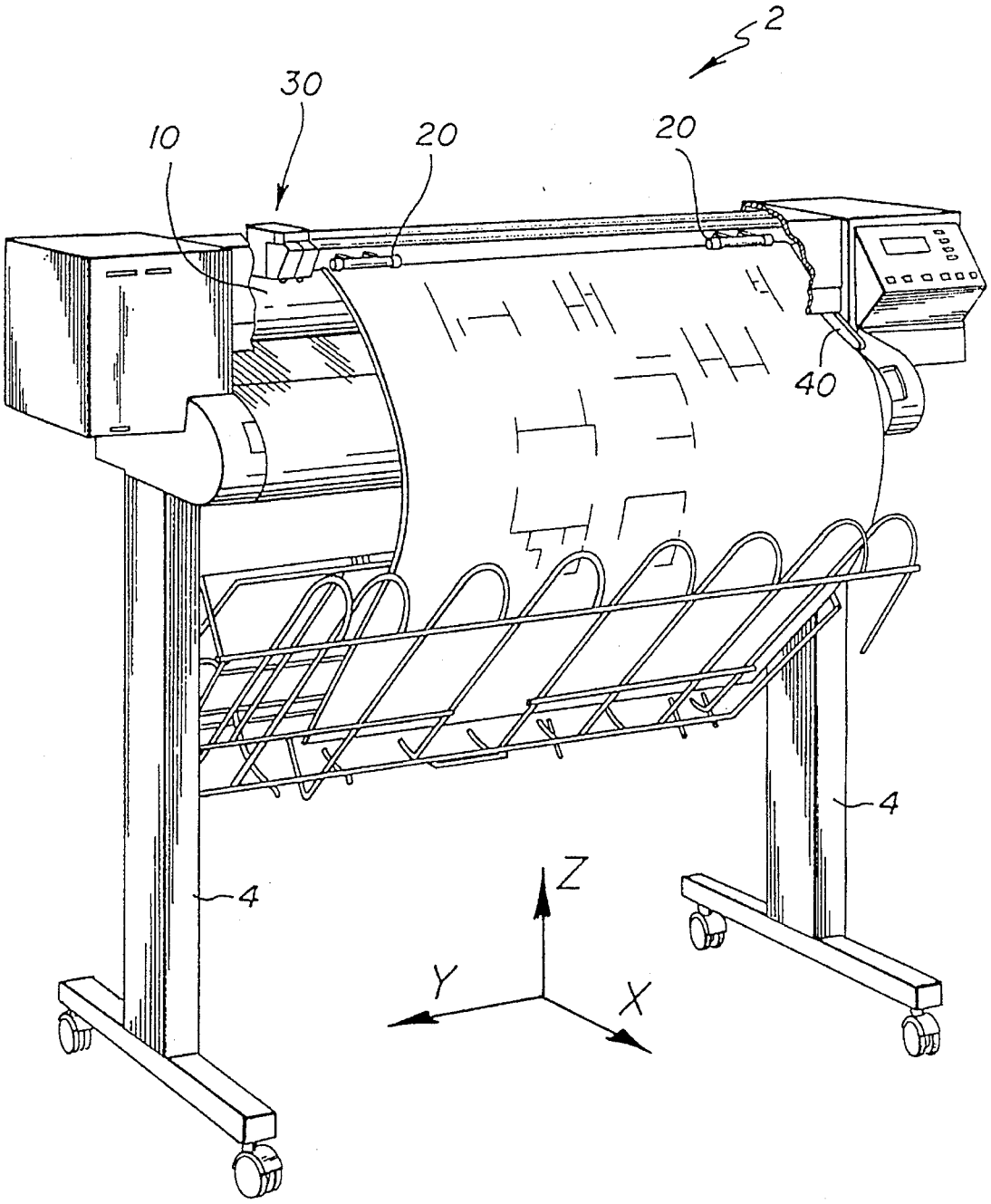
FIG. 1 is a perspective view of a printer/plotter mechanism showing the cover partly broken away to reveal a platen roller, pinch rollers and a print head carriage mounted on slider rods which extend parallel to the axis of the platen roller.

FIG. 1 is a perspective view of a printer/plotter mechanism having a chassis 2 supported by a pair of spaced legs 4 and a housing which includes a generally arcuate cover 6 for containing a roll 7 (FIG. 3) of print medium such as paper, vellum or film. As seen in the broken away section at the top of FIG. 1, a platen roller 10 extends transversely of the apparatus in the Y direction to provide a support and printing path at its upper surface for the medium upon which printing is to take place. A pair of slider rods 12 (FIG. 3) support a transversely movable print head carriage 30 having a thermal inkjet print head 32 or a plurality of thermal inkjet print heads mounted thereon which are positioned a precise distance above the platen roller 10. The top portions of four pinch rollers 20, two each being mounted on the tops of two different printer roller support members 25 which will be described below are also shown as is an actuating lever 40 for moving the print roller support members into and out of their operative position.

Figure 2:
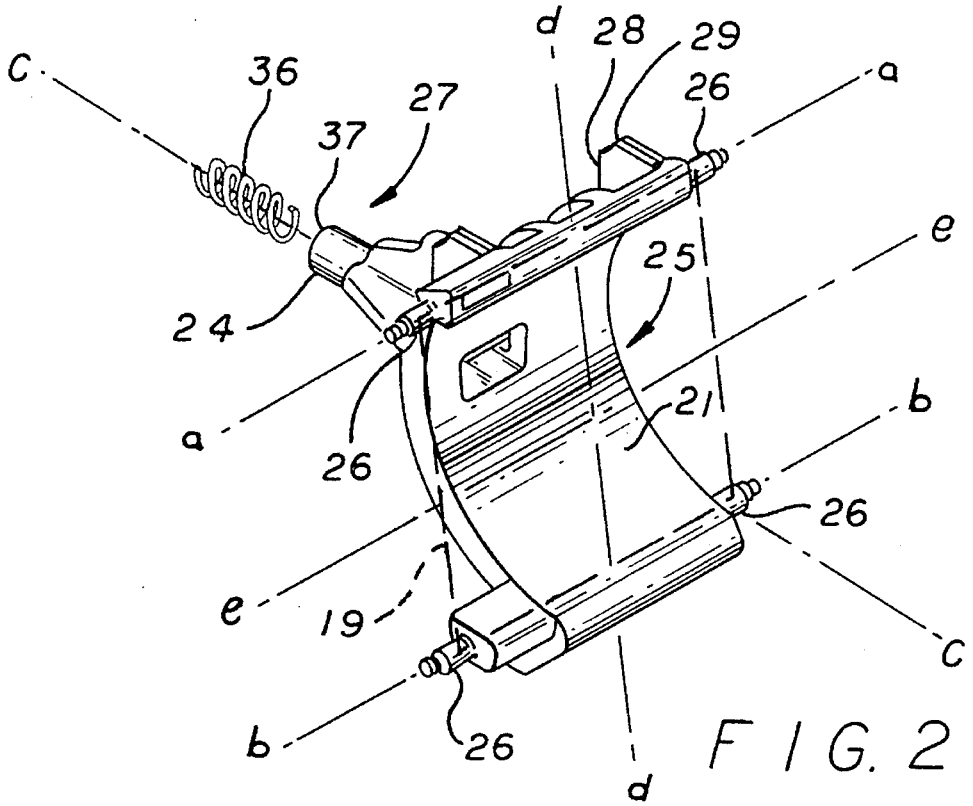
FIG. 2 is a perspective view of a pinch roller support member having an arcuate media guide surface.

Turning now to FIG. 2, each pinch roller support member 25 is seen to comprise an injection molded plastic part having a generally arcuate configuration of slightly larger radius than the radius of the platen roller 10 adjacent to which it is mounted. This arcuate configuration provides an arcuate media guide surface 21. The pinch roller support member is seen to have two spaced parallel axes and four pinch roller axles 26 for mounting four pinch rollers 20 at its corners. The pinch rollers 20 are simply slipped onto the axles 26 and retained thereon by spring collars (not shown) as is well known. The upper two of the pinch roller axles are disposed on a common first axis a—a, and the lower two pinch roller axles are disposed on a second common axis b—b parallel to the first axis.

The pinch roller support member 25 is also seen to have an elongate integrally formed support and actuation arm 27 extending from the surface thereof opposite from the arcuate media guide surface 21. The support and actuation arm 27 is preferably positioned substantially, but not precisely, in the middle of a polygon having one of the pinch rollers 20 at each corner thereof. More specifically, the arm 27 is positioned on the vertical centerline (d—d) of a rectangle 19 having one each of the pinch rollers 20 at the corners thereof and is aligned such that the axis c—c of the support and actuation arm 27 intercepts the axis (e—e) of generation of the arcuate surface 21 whereby it will also intersect the axis of rotation of the platen roller 10 when the pinch roller support member 25 is disposed in its pinching position. In this position, the pinch rollers 20 pinch the printing medium against the exterior cylindrical surface of the platen roller 10 and the four pinch rollers 20 are constrained to their proper position by the platen roller 10. Preferably, the axis a—a of the two upper pinch rollers is located slightly closer to the axis c—c of the arm 27 than is the axis b—b of the two lower pinch rollers.

Figure 3:
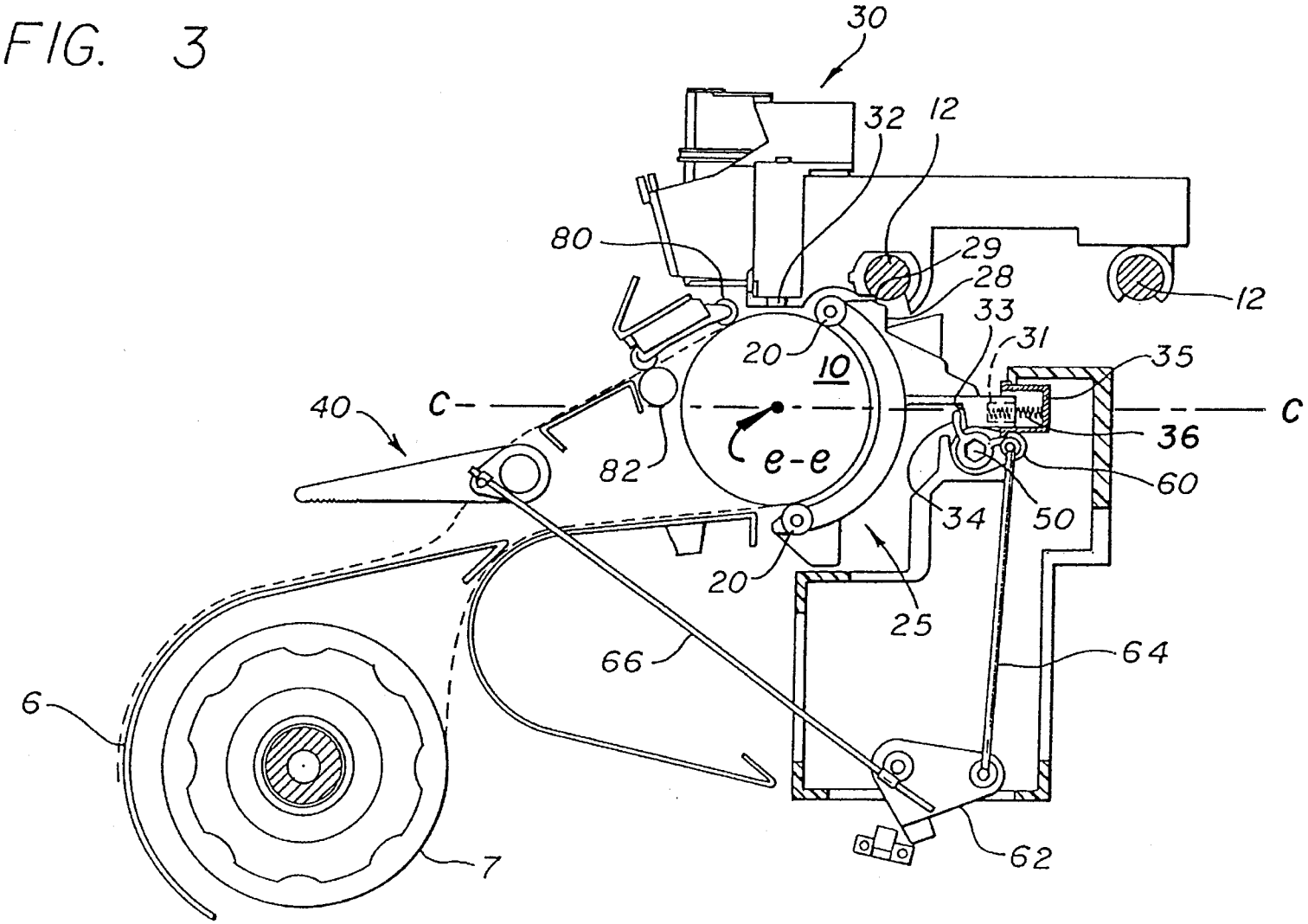
FIG. 3 is right hand cross sectional elevation showing the ends of the platen roller, pinch rollers and mechanism for moving the pinch roller support member into and out of an operative position.

In FIG. 3, the paper or other print media path is shown by the dashed line. Also as best seen in FIG. 3, the pinch roller support member 25 has at least one rearwardly extending upper stabilizer shoulder 28 having an arcuate surface 29 thereon which limits upward motion of the pinch roller support member 25 when it is retracted away from the platen roller 10 by abutment of the surface 29 with one of two printer carriage slider rods 12 mounted on the chassis of the printer/plotter. A generally cylindrical support bearing 24 is provided at the rearward end of the support arm 27 and is seen (FIG. 3) to have a bore 31 in the end thereof which receives one end of a compression spring 36.

A support bearing 35 is mounted on the printer/plotter chassis and has a circular/cylindrical interior surface which receives and supports the support arm 27. The inside diameter of the surface of bearing 35 is made slightly larger than the outside diameter of the bearing surface on the support arm 27 to permit vertical movement of the arm 27 in the bearing 35 within a selected angular tolerance. The distance from a captured end 37 of the support arm 27 to the centerline of the platen roller 10 is preferably about twice the distance from the centerline of the pinch rollers to the center of curvature (e—e) of the arcuate media guide surface 21 which also generally coincides with the centerline of the platen roller 10. The compression spring 36 thus biases the pinch roller support member 25 and pinch rollers 20 toward the platen roller during printing. Thus, if the captured end 37 of the support arm is vertically diplaceable in the bearing 35 within the selected angular tolerance, the pinchroller position will shift angularly around the platen roller 10 only about one half the selected angular bearing tolerance because the assembly is constrained to rotate about the center of the platen roller 10.

When it is desired to load a sheet of printing medium into the printer/plotter or printing medium either manually or from the roll 7 thereof, the paper is fed until movement of the lead end thereof is terminated by abutment in the nap between the lower pinch rollers 20 and the platen roller 10. The platen roller is then rotated in a counterclockwise direction (as seen in FIG. 3) to draw the paper between the platen roller 10 and the arcuate guide surface of the roller support member 25 and subsequently past the upper pinch rollers 20. Paper can be removed when desired by retracting the pinch roller support member 25 and pinch rollers 20 away from the platen roller 10. For this purpose, the support and actuation arm 27 has a substantially vertically extending shoulder 33 thereon which may be engaged by a retainer arm 34 which is fixedly attached to a transversely extending shaft 50 mounted in the printer/plotter chassis. Rotation of the shaft 50 to retract the pinch roller support member 25 to its open non-pinching position is accomplished by affixation of a bellcrank 60 to the shaft 50 so that the shaft may be rotated by movement of the bellcrank 60 which is in turn attached to a second bellcrank 62 by a connecting rod 64. The second bellcrank 62 is connected to the pinch arm release handle 40 by another connecting rod 66, the bellcranks and pinch arm release levers being pivotally affixed to the printer/plotter chassis or rotatable shaft 50 in a manner which will be apparent to persons skilled in the art. It will be appreciated that a number of separate pinch roller support members 25 may be mounted along the length of the platen roller 10 and that all may be commonly moved to their operative position or retracted therefrom by providing a number of retainer arms 34 on the rotatable shaft 50 which is turned when desired by the pinch arm release lever linkage.

Figure 4:
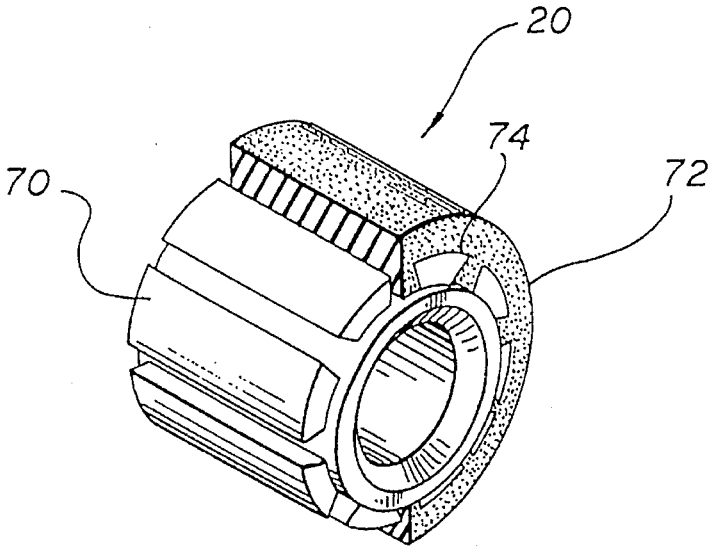
FIG. 4 is an enlarged perspective view, partly broken away, showing a two piece injection molded pinch roller.

As seen in FIG. 4, the pinch rollers 20 individually comprise a two piece construction consisting of a relatively hard hub 70 and a relatively soft traction tire 72 thereon, the tire being mechanically affixed to the hub by a dovetailed circular joint 74 wherein some of the tire material is disposed radially inwardly and underneath some of the hub material whereby the tire is firmly locked in position both radially and circumferentially to the hub 70.

The hubs 70 are preferably injection molded in a single shot from relatively hard plastic materials such as nylon and the tire portion 72 of the pinch rollers 20 may be subsequently injection molded onto the hubs 70 whereby the rollers 20 are easily constructed by a two shot injection molding process. The tire portions 72 are preferably polyurethane since this material has been found to have no additives which leave undesirable deposits on the paper or other print medium. It has been found that some elastomeric castable materials have additives therein which react with the paper and/or ink and result in destruction of print quality.

Although the mode of operation of the invention will by now have become substantially apparent to persons skilled in the art, it will be seen that the manner of mounting of the pinch roller support member 25 by using a single support and actuation arm 27 integrally formed therewith permits rotation of the pinch roller support member 25 about the axis c—c of the support arm 27 and that the selected tolerance in the bearing 35 permits rotation of the roller support member 25 about at least two mutually perpendicular axes (X and Y) and translation thereof along the axis c—c of the support arm 27 (the X axis).

The construction disclosed permits close placement of the uppermost ones of the pinch rollers 20 on each roller support member proximate the print area on the upstream side thereof as considered in the direction of movement of the print medium. The pinch rollers 20 are closely spaced to but do not interfere with transverse movement of the print head carriage 30 along the rods 12.

Also closely adjacent the print head carriage 30 on the opposite side of the print path from the pinch rollers are a plurality of spring urged toothed drive rollers 80 for pulling the print medium past the print head or heads 32 whereby it can be seen that the print medium is tightly pinched against the exterior surface of the platen roller 10 on both sides of the print path to maintain a precise distance (vertical spacing in the Z direction) below the thermal inkjet print head 32 whereby print resolution is carefully controlled. Pinch rollers of the type described above may also be positioned as shown at 82 in opposition to the toothed rollers 80.

We claim:

1. A printing media feed and retaining apparatus for a computer driven primer/plotter comprising:

a) a pinch roller support member having an arcuate media guide surface thereon, said arcuate media guide surface having an axis of generation, said support member being moveable into and out of a pinching position adjacent a platen roller;

b) said pinch roller support member having at least three pinch rollers freely rotatably mounted on said print roller support member on at least two spaced parallel roller axes; and c) said pinch roller support member having a support and actuation arm extending therefrom on a side opposite said arcuate media guide surface, said arm having a central axis and said arm being positioned with respect to the pinch rollers so that said central axis intersects a centerline through a point substantially in the middle of a polygon figure defined by lines connecting the pinch rollers and having one each of said pinch rollers at intersections of the sides of said polygon figure.

2. The apparatus of claim 1, wherein said pinch roller support member has four rollers mounted thereon, two of said rollers being mounted for free rotation about a first axis and two being mounted for rotation about a second axis, said first and second axes being parallel to each other.

3. The apparatus of claim 2, wherein said polygon figure is a rectangle, and said support arm is positioned on at least one centerline of the rectangle which has a pinch roller at each of its corners.

4. The apparatus of claim 1, wherein the axis of generation of the center of curvature of said arcuate media guide surface is parallel to said spaced parallel roller axes.

5. The apparatus of claim 1, further including at least one motion limiting abutment shoulder on the side of said pinch roller support member opposite said arcuate media guide surface for limiting movement of said pinch roller support member in a direction away from said pinching position.

6. The apparatus of claim 5, wherein said support arm has a free end and an axis extending therethrough and a circular support bearing surface on said free end for permitting rotation of said pinch roller support member about said axis of said support arm when mounted in a printer/plotter apparatus.

7. The apparatus of claim 6, wherein said axis of said support arm intersects the center of curvature of said media guide surface.

8. The apparatus of claim 7, wherein the distance between said free end of said support arm and the center of curvature of said media guide surface is twice the distance between the centerline of said pinch rollers and the center of curvature of said media guide surface.

* * * * *